United States Patent [19]

Versaci

[11] Patent Number: 4,641,578

[45] Date of Patent: Feb. 10, 1987

[54] METHOD AND DEVICE FOR AUTHENTICATION OF FIRST DAY OF ISSUE STAMPS

[76] Inventor: Antonio A. Versaci, 2528 Peters La., Schenectady, N.Y. 12309

[21] Appl. No.: 743,783

[22] Filed: Jun. 12, 1985

[51] Int. Cl.[4] ..... B65P 27/04

[52] U.S. Cl. ..... 101/426; 229/71; 40/2 B; 283/51

[58] Field of Search ..... 229/71, 68 R; 428/43, 428/916; 40/2 B; 283/71, 51, 44, 1 B; 101/1, 426

[56] References Cited

U.S. PATENT DOCUMENTS

| | | | |
|---|---|---|---|
| 1,136,163 | 4/1915 | O'Brien | 40/2 B |
| 1,634,240 | 6/1927 | Wilford | 283/51 |
| 1,988,908 | 1/1935 | Mackinnon | 229/71 |
| 3,692,233 | 9/1972 | Carter, Jr. | 229/71 |
| 3,830,422 | 8/1974 | Dunn | 229/71 |
| 4,012,857 | 3/1977 | Leskovec, Jr. | 40/2 B |

FOREIGN PATENT DOCUMENTS

| | | | |
|---|---|---|---|
| 348037 | 3/1905 | France | 283/71 |
| 157687 | 12/1932 | Switzerland | 283/1 B |
| 1474209 | 5/1977 | United Kingdom | 40/2 B |

*Primary Examiner*—William Pieprz

*Attorney, Agent, or Firm*—Charles W. Helzer

[57] ABSTRACT

A method for first day of issue authentication of sheets of original stamps containing a selvage edge integrally formed with the sheet of stamps during printing wherein the method comprises affixing an extra original stamp of the same issue as the sheet of original stamps being authenticated in-line with an exposed portion of the selvage edge, a First Day of Issue cancellation seal then is applied to the exposed portion of the selvage edge in a manner such that the bulls eye and a portion of the killer bar segments containing the first day of issue notice is applied directly to the selvage edge and only the terminal ends of the killer bar extend to and cancel the extra original stamp.

17 Claims, 4 Drawing Figures

METHOD AND DEVICE FOR AUTHENTICATION OF FIRST DAY OF ISSUE STAMPS

TECHNICAL FIELD

This invention relates to the practice of authentication of United States or other postal system stamps on the first day of issue of a new stamp.

In particular, the invention relates to a novel method and device for use in the authentication of a new stamp on the first day of issue of such stamp by the application of an authenticating First Day of Issue cancellation seal to sheets of a plurality of the new stamps integrally connected with each other by a perforated web of paper material on which the stamps are printed.

BACKGROUND OF INVENTION

For many years the United States postal system as well as many foreign postal systems have cancelled postage applied to envelopes, postal cards and various other stationary or parcel post objectes, by applying a cancellation seal to the postage stamp affixed to the envelope. The cancellation seal is applied by a hand stamp or machine cancelling devices. To be thus cancelled, it is a requirement by law that the stamp being cancelled be affixed to the exterior of the envelope, post card, etc., and the cancellation seal impressed on the stamp containing the name of the post office and the date of cancellation.

In the case where a new series of stamps is being issued, because of demand by stamp collectors, the post office on the first day of issue of the new series will apply a special seal in conducting the cancellation procedure. This special First Day of Issue cancellation seal includes a bulls eye portion having the date and the name of the post office thereon together with a killer bar cancellation segment which produces a quantity of parallel wavy lines that extend over the stamp being cancelled. In this special First Day of Issue cancellation seal, the words "First Day of Issue" are included along with the killer bar segments. In the past, the First Day of Issue cancellation seal customarily has been used in cancelling stamps only on the first day of issue of the stamp. However, in recent years, the first day cancellation privileges have been extended for a thirty day period for the convenience of the post offices to reduce work load based on first day of issue cancellation by collectors. This turn of events has impaired somewhat the "First Day of Issue" cancellation integrity, thereby lessening the value of authenticity to a sheet of first day of issue stamps obtained by collectors.

It is a particular object of the present invention to provide for authentication of large sheets of stamps in a manner which would be truly valid with respect to the "First Day of Issue" particularly with respect to whole sheet quantities of stamps. Heretofore, whole sheets of stamps have been cancelled by the post office with a First Day of Issue cancellation seal which cancels four stamps simultaneously. In cases where a panel or pane of say thirty-two stamps on a sheet are to be cancelled, multiple application of the cancellation seal is required thereby greatly increasing the work load on the post offices. This past process also results in marring the appearance of the stamps, thereby decreasing their value.

SUMMARY OF INVENTION

In order to overcome the above problems and still conform to postal regulations which prohibit the use of a First Day of Issue cancellation seal on anything but valid postage, the present invention was devised.

According to the present invention, First Day of Issue authentication of sheets of stamps is achieved by application of a hand held or machine type cancellation seal onto the integrally formed selvage edge of a sheet comprising a plurality of stamps all of which still are integrally held together by reason of a perforated web of paper interposed between each stamp and adjacent stamps in the sheets in a well known manner. By placement of the First Day of Issue cancellation seal on the selvage edge of the sheet, which likewise is integrally formed on the same paper with the plurality of stamps in the sheet, but is separated therefrom by a perforated web of paper, it is possible to apply the First Day of Issue cancellation seal in one cancelling operation instead of multiple strikes as required previously. Further, by placement of the cancellation on the selvage edge of the stamps, disfigurement of the stamps themselves is prevented. A problem to be overcome, however, is that the selvage edge of a sheet of stamps is not, nor has it ever been valid for postage, and therefore application of the cancellation seal to the selvage edge alone may not be in total conformance with applicable postal regulations. The present invention overcomes this problem in the following manner.

First Day of Issue authentication of a sheet of original stamps containing an integrally formed selvage edge is achieved by affixing an extral original stamp of the same issue as the sheet of original stamps being authenticated in line with an exposed portion of the selvage edge. A First Day of Issue cancellation seal then is applied which includes a bulls eye containing the date and name of the post office performing the authentication and a portion of the killer bar cancellation segment of the cancellation seal to the exposed portion of the selvage edge in such a manner that the terminal ends of the killer bar cancellation segments of the cancellation seal impinge upon and cancel the extra original stamp affixed in line with the exposed selvage edge portion of the sheet of stamps being authenticated.

One method of First Day of Issue authentication according to the invention outlined above is to apply the extra original stamp of the same issue as the sheet of original stamps being authenticated by affixing the extra stamp in line with the exposed portion of the selvage edge by adhesively securing the extra original stamp directly to the exposed selvage edge adjacent and in-line with the area of the selvage edge to which the First Day of Issue cancellation seal is applied.

A second method according to the invention is to affix the extra original stamp of the same issue as the sheet of original stamps being authenticated by adhesively securing the extra original stamp to a peelable adhesive label removably secured to the exposed selvage edge adjacent to and in-line with the area of the selvage edge to which the First Day of Issue cancellation seal is applied.

A third and preferred method of authentication according to the invention is to enclose a sheet of original stamps to be authenticated within an enclosing envelope which has an open window positioned to expose the portion of the selvage edge upon which the First Day of Issue cancellation seal impinges. The extra original stamp of the same issue then is secured to the exterior of the envelope immediately adjacent the open window in a position such that the bulls eye containing the date and name of post office performing the authentication and a portion of the killer bar cancellation segments of the cancellation seal strikes the exposed portion of the selvage edge through the open window, and the terminal ends of the killer bar segments of the seal impinge upon and cancel the extra original stamp affixed to the exterior of the envelope adjacent the window.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters and wherein.

BEST MODE OF PRACTICING THE INVENTION

Original issue sheets of stamps supplied by the U.S. Government Printing Office for use in the postal system historically have come with one hundred twenty-eight or more stamps in each sheet. The printer breaks the sheet up into four equal panes.

In practicing the present invention, this same procedure will be used but it will be essential to retain the original integrally formed selvage edge of the sheet of stamps to go with each of the four panels whereby the invention may be practiced as taught herein.

Figure 1:
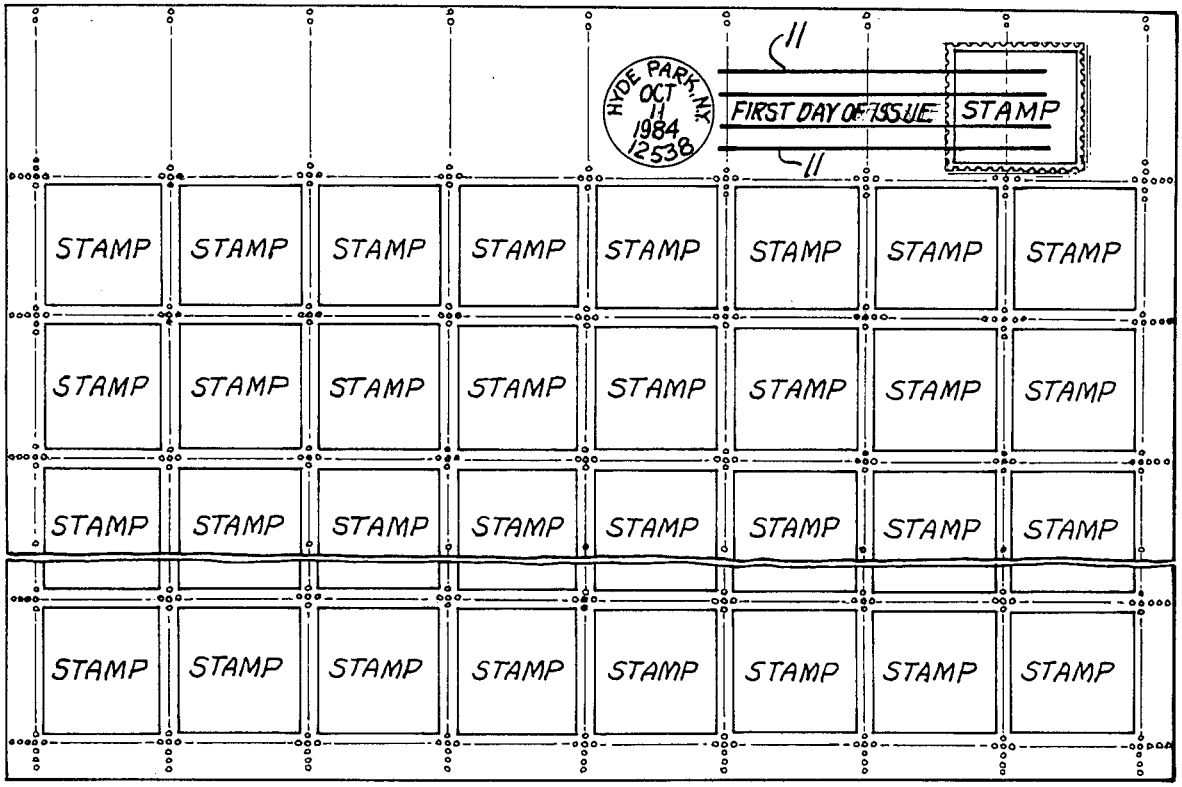
FIG. 1 is an illustration of the first method of practicing the invention wherein an extra original stamp of the same issue as the sheet of original stamps being authenticated is adhesively secured directly to the exposed selvage edge adjacent to and in-line with the area of the selvage edge to which the First Day of Issue cancellation seal is applied so that the terminal end of the killer bar segment overlaps and cancels the extra original stamp.

Using the first method according to the invention as illustrated in FIG. 1, a sheet (pane) of original stamps containing an integrally formed selvage edge separated from the stamps themselves by a perforated line or webbing of paper on which the sheet of stamps were printed, is obtained. An extra original stamp of the same issue as the sheet of stamps is obtained either from the panel of stamps being authenticated or from another sheet of the same issue, and is affixed to an exposed portion of the selvage edge. The panel of stamps is then taken to the post office where it is to be authenticated with the First Day of Issue cancellation seal. This is done by instructing the postmaster or other postal official performing the cancellation to apply the First Day of Issue cancellation seal as shown at the top of FIG. 1. The seal will include a bulls eye portion shown in the drawing as round with the name of the authenticating post office, in the example shown Hyde Park, New York. The bulls eye also includes the date when the first day of issue cancellation seal was applied together with the zip code number of the post office. In addition, the First Day of Issue Cancellation seal includes a plurality of killer bar cancellation segments shown at 11 which comprise a plurality of straight or wavy spaced-apart parallel lines within which the words "First Day of Issue" are imprinted. By proper placement of the cancellation seal, the exposed selvage edge portion is clearly stamped with the "First Day of Issue" notice and only the terminal end portions of the killer bar cancellation segment extend over to and cancel the extra original stamp adhesively secured to the selvage edge portion of the sheet of stamps. The cancellation process thus described complies fully with the requirements of US Postal Regulations in that it does effectively cancel an original stamp as required by the regulations, but does not result in marring the appearance of the sheet or pane of original stamps being authenticated. Because the authenticating First Day of Issue cancellation seal is applied to the integrally formed selvage edge along with the pane of stamps, it is conclusive proof of the fact that all of the stamps in the pane still integrally attached with the selvage consititute authentic first day of issue stamps. In some postal facilities it may not be required to use the extra original stamp on the selvage edge in which event all of the First Day of Issue cancellation seal is applied directly to the selvage edge to achieve cancellation of the sheet or pane of original stamps.

Figure 2:
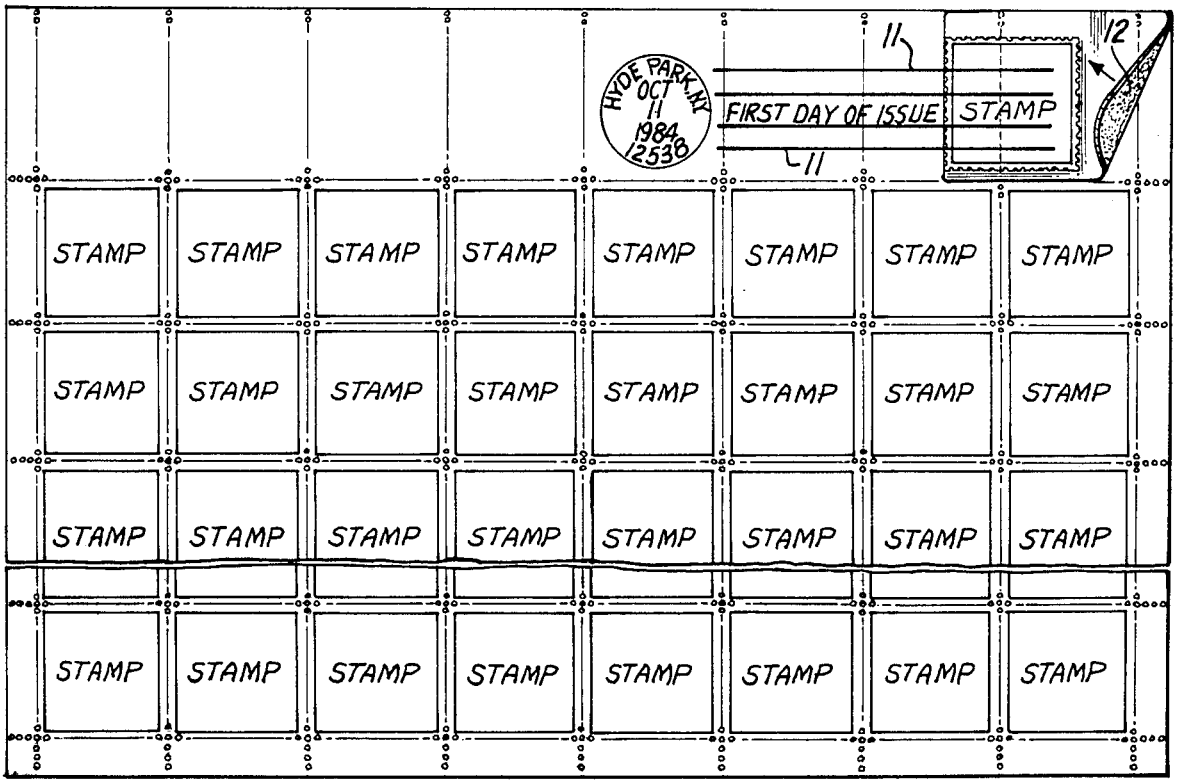
FIG. 2 of the drawings illustrates the second method according to the invention whereby the extra original stamp to be cancelled by the First Day of Issue cancellation seal is directly applied to a peelable label and the peelable label movably secured to the selvage edge of the sheet of stamps in a manner such that the terminal ends of the killer bar segments of the seal overlap and cancel the extra original stamp.

From the viewpoint of a dealer or stamp collector who buys and sells stamps, the addition of the extra original stamp which has been cancelled in FIG. 1, constitutes a certain degree of marring of the appearance of the entire sheet of original, first day of issue stamps and detracts from their value. To overcome this, a second method illustrated in FIG. 2 of the drawings. With reference to FIG. 2, it is seen that the extra original stamp of the same issue is applied first to a peelable label 12. The peelable label 12 itself is applied to its reverse side and adhesive which does not permanently grip the surface to which the peelable label is applied and may be of the type that can be readily obtained from any convenient office supply store. The peelable label with attached extra original stamp then is affixed to the exposed portion of the selvage edge of a sheet or pane of stamps to be authenticated. Here again the peelable label is positioned on the exposed selvage edge so that only the terminal ends of the killer bar segments will strike the extra original stamp and cancel it pursuant to postal regulations. Using this method, the bulls eye with date and cancellation site leaves a clear impression of the exposed selvage edge together with a portion of the killer bar segments including the First Day of Issue Seal. The terminal ends of the killer bar are impressed on the label and the stamp. When the label is removed, a clear First Day of Issue mark together with date and site named plus some of the killer bar segments remains on the selvage which otherwise is unmarred. This method also meets all postal requirements.

Figure 3:
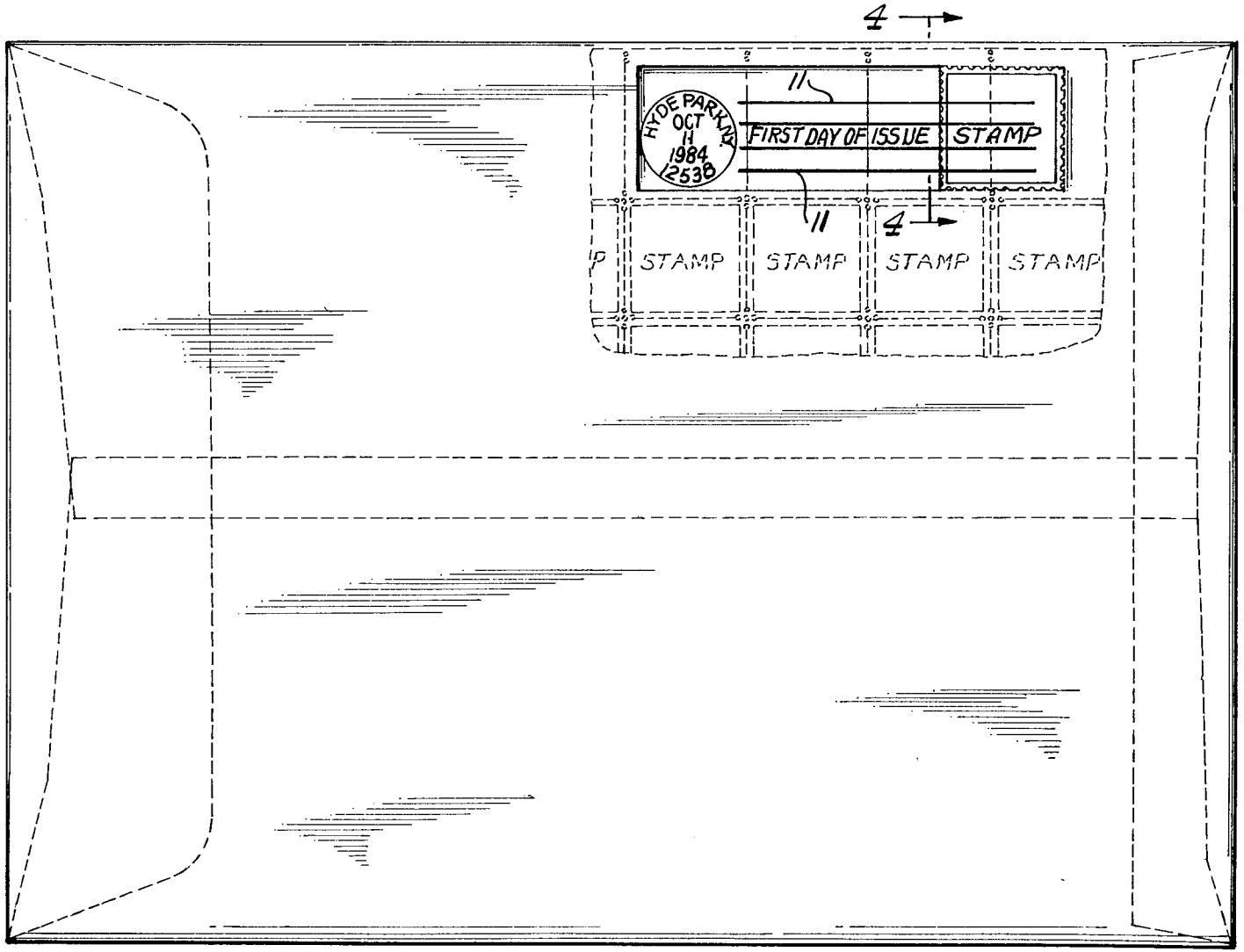
FIGS. 3 and 4 illustrate the preferred third method of practicing the invention wherein the sheet of stamps to be authenticated is contained within an enclosing envelope which has an open window positioned to expose the portion of the selvage edge upon which the First Day of Issue cancellation seal impinges and the extra original stamp of the same issue is secured to the exterior of the envelope immediately adjacent the open window.
Figure 4:
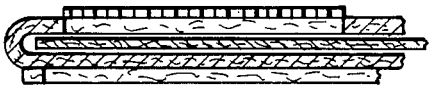

Because the first two methods require that the sheets of stamps being authenticated be exposed during the sealing measures described above, it is possible that either side of the sheet of stamps could be damaged in someway by moisture, dust accumulation, etc. To overcome this problem, a preferred method of authentication according to the invention is illustrated in FIGS. 3 and 4 of the drawings. In FIG. 3 an appropriate sized envelope to accommodate the sheet or pane of stamps is treated by forming an open window in the envelope at a position which conforms with the placement of the selvage edge to be exposed when the sheet of stamps is inserted in the envelope. A portion of the surface of the envelope in which the open window is formed is left so that immediately adjacent the open window, an extra original stamp of the same issue as the sheet of stamps to be authenticated, is affixed immediately adjacent the window. With the sheet of stamps to be authenticated thus positioned in the protective envelope and a portion of the selvage edge exposed which is sufficient to accommodate the First Day of Issue cancellation seal, the envelope is processed by the postal official by applying the First Day of Issue seal either manually or by machine to the exposed portion of the selvage edge appearing through the open window in the envelope. FIG. 4 is a cross-sectional view taken through plane 4—4 of FIG. 3. With this arrangement the date and site information appearing in the bulls eye portion of the seal and the killer bar segment including the First Day of Issue notice is impressed on the exposed selvage edge and only the terminal end portions of the killer bar segments are applied to the extra original stamp on the exterior of the envelope immediately adjacent the open window. This too is an acceptable method of cancellation to U.S. postal authorities.

Using all three methods of cancellation described above, and particularly method number 3 employing the open window envelope, authentic "First Day of Issue" cancellation of significant numbers of sheets of stamps can be applied by the post office during the actual twenty-four hour period of the true "First Day of Issue" of a new series of stamps. This can be done readily without unduly overloading the post office where authentication is sought since individual authentication of all of the stamps in the sheet is not required. Even though each individual stamp is not struck with the First Day of Issue cancellation seal, such authentication at the issuing site still nevertheless can be proven and certified to by a dealer or collector as being authentic since all of the stamps are integrally connected with the integrally formed selvage edge via the perforated webbing of the same sheet of paper on which the stamps are printed. As a result, the possibility of establishing a legitimate subscription service offering authentic first day of issue hand cancelled sheets of postage stamps to a customer becomes feasible.

From the foregoing description, it will be appreciated that the invention makes available new and improved methods of authentication of sheets of stamps wherein authentication is defined as the verification of the date and site of issuance of a stamp by application of a hand held or machine type cancelling seal onto the integral selvage edge of a sheet of original stamps of a new issue. By placement of the cancellation seal on the integrally formed selvage edge, disfigurement of the stamps is prevented thereby enhancing their value.

INDUSTRIAL APPLICATION

This invention describes new and improved methods for cancellation of new issues of postage stamps by applying the First Day of Issue cancellation seal containing the date and postal site where cancellation takes place to the integrally formed selvage edge of a sheet of stamps thereby confirming that all of the stamps in the sheet are authentic first day of issue stamps without marring the appearance and reducing the value of the stamps in the sheets.

Having described several embodiments of method and device for authentication of first day of issue stamps according to the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A method for first day of issue authentication of a sheet of original stamps containing a selvage edge integrally formed with the sheet of stamps during printing; said method comprising affixing an extra original stamp of the same issue as the sheet of original stamps being authenticated in-line with an exposed portion of the selvage edge, and applying the First Day of Issue cancellation seal which includes a bulls eye containing the date and name of the post office performing the authentication and a portion of the killer bar cancellation segments of the cancellation seal to the exposed portion of the selvage edge in a manner such that the terminal ends of the killer bar cancellation segments of the seal impinge upon and cancel the extra original stamp affixed in-line with the exposed selvage edge portion of the sheet of stamps being authenticated.

2. The method of stamp authentication according to claim 1 wherein the extra original stamp of the same issue as the sheet of original stamps being authenticated is affixed in-line with the exposed portion of the selvage edge by adhesively securing the extra original stamp directly to the exposed selvage edge adjacent to and in-line with the area of the selvage edge to which the First Day of Issue cancellation seal is applied.

3. The method of stamp authentication according to claim 1 wherein the extra original stamp of the same issue as the sheet of original stamps being authenticated is affixed in-line with the exposed portion of the selvage edge by adhesively securing the extra original stamp to a peelable adhesive label removably secured to the exposed selvage edge adjacent to and in-line with the area of the selvage edge to which the First Day of Issue cancellation seal is applied.

4. The method of stamp authentication according to claim 1 wherein the sheet of stamps to be authenticated is contained within an enclosing envelope which has an open window positioned to expose the portion of the selvage edge upon which the First Day of Issue cancellation seal impinges.

5. The method of stamp authentication according to claim 4 wherein the extra original stamp of the same issue is secured to the exterior of the envelope adjacent the open window in a position such that the bulls eye containing the date and name of the post office performing the authentication and a portion of the killer bar cancellation segments of the cancellation seal strike the exposed portion of the selvage edge through the open window and the terminal ends of the killer bar segments of the seal impinge upon and cancel the extra original stamp affixed to the exterior of the envelope adjacent the window.

6. The method of stamp authentication according to claim 1 wherein the First Day of Issue cancellation seal is applied to the exposed portion of the selvage and the extra original stamp of the same issue by stamping the cancellation seal on the selvage under the supervision of a responsible postal official to thereby provide a simple, efficient and effective one step authentication of sheets of stamps on the first day of issue.

7. The method of stamp authentication according to claim 6 wherein the extra original stamp of the same issue as the sheet of original stamps being authenticated is affixed in-line with the exposed portion of the selvage edge by adhesively securing the extra original stamp directly to the exposed selvage edge adjacent to and in-line with the area of the selvage edge to which the First Day of Issue cancellation seal is applied.

8. The method of stamp authentication according to claim 6 wherein the extra original stamp of the same issue as the sheet of original stamps being authenticated is affixed in-line with the exposed portion of the selvage edge by adhesively securing the extra original stamp to a peelable adhesive label removably secured to the exposed selvage edge adjacent to and in-line with the area of the selvage edge to which the First Day of Issue cancellation seal is applied.

9. The method of stamp authentication according to claim 6 wherein the sheet of stamps to be authenticated is contained within an enclosing envelope which has an open window positioned to expose the portion of the selvage edge upon which the First Day of Issue cancellation seal impinges, and wherein the extra original stamp of the same issue is secured to the exterior of the envelope adjacent the open window in a position such that the bulls eye containing the date and name of the post office performing the authentication and a portion of the killer bar cancellation segments of the cancellation seal strike the exposed portion of the selvage edge through the open window and the terminal ends of the killer bar segments of the seal impinge upon and cancel the extra original stamp affixed to the exterior of the envelope adjacent the window.

10. The method according to claim 1 wherein each stamp in the sheet of stamps being authenticated is integrally formed on a sheet of paper with the other stamps in the sheet but is readily separable therefrom by a line of perforations surrounding each stamp and the selvage edge likewise is integrally formed on the sheet of paper with the stamps of the sheet but is readily separable therefrom by a line of perforations similar to those surrounding each stamp.

11. The method of stamp authentication according to claim 10 wherein the First Day of Issue cancellation seal is applied to the exposed portion of the selvage and the extra original stamp of the same issue by stamping the cancellation seal on the selvage under the supervision of a responsible postal official to thereby provide simple, efficient and effective one step authentication of sheets of stamps on the first day of issue.

12. The method of stamp authentication according to claim 11 wherein the extra original stamp of the same issue as the sheet of original stamps being authenticated is affixed in-line with the exposed portion of the selvage edge by adhesively securing the extra original stamp directly to the exposed selvage edge adjacent to and in-line with the area of the selvage edge to which the First Day of Issue cancellation seal is applied.

13. The method of stamp authentication according to claim 11 wherein the extra original stamp of the same issue as the sheet of original stamps being authenticated is affixed in-line with the exposed portion of the selvage edge by adhesively securing the extra original stamp to a peelable adhesive label removably secured to the exposed selvage edge adjacent to and in-line with the area of the selvage edge to which the First Day of Issue cancellation seal is applied.

14. The method of stamp authentication according to claim 11 wherein the sheet of stamps to be authenticated is contained within an enclosing envelope which has an open window positioned to expose the portion of the selvage edge upon which the First Day of Issue cancellation seal impinges, and wherein the extra original stamp of the same issue is secured to the exterior of the envelope adjacent the open window in a position such that the bulls eye containing the date and name of the post office performing the authentication and a portion of the killer bar cancellation segments of the cancellation seal strike the exposed portion of the selvage edge through the open window and the terminal ends of the killer bar segments of the seal impinge upon and cancel the extra original stamp affixed to the exterior of the envelope adjacent the window.

15. An envelope specially designed for use in first day of issue authentication of a sheet of original stamps containing a selvage edge integrally formed with the sheet of stamps during printing, said envelope having a flat surface and being of a size to receive a flat sheet of a number of integrally interconnected original stamps and their interconnected integrally formed selvage edge portion with the selvage edge portion retained near an edge portion of the envelope, said envelope having an open window formed in one of the flat surfaces thereof over said edge portion of the envelope for receiving and retaining the selvage edge portion of the sheet of stamps with the open window exposing a portion of the selvage edge of the sheet of stamps for application of a First Day of Issue cancellation seal to the exposed selvage edge portion through the open window and wherein the envelope further includes an integral portion of the flat surface of the envelope immediately adjacent the side of the open window on the side thereof to which a stamp normally is applied of sufficient dimension to accommodate affixing thereto an extra original stamp of the same issue as the sheet of stamps to be authenticated and with the open window being of sufficient size to accommodate passage of a First Day of Issue cancellation seal applying device therethrough for applying the bulls eye containing the date and name of post office performing the authentication and a portion of the killer bar segments of the First Day of Issue cancellation seal to the portion of the selvage edge exposed through the open window with the terminal ends of the killer bar segments of the seal extending sufficiently to impinge upon and cancel an extra original stamp of the same issue affixed to the exterior of the envelope immediately adjacent to said open window.

16. A method for first day of issue authentication of a sheet of original stamps containing a selvage edge integrally formed with the sheet of stamps during printing; said method comprising applying the First Day of Issue cancellation seal which includes a bulls eye containing the date and name of the post office performing the authentication and killer bar cancellation segments of the cancellation seal to the exposed portion of the selvage edge in a manner such that the bulls eye and killer bar cancellation segments of the seal impinge upon and are affixed in-line with the exposed selvage edge portion of the sheet of stamps being authenticated.

17. The method of stamp authentication according to claim 16 wherein an extra original stamp of the same issue as the sheet of original stamps being authenticated is affixed in-line with the exposed portion of the selvage edge by adhesively securing the extra original stamp directly to the exposed selvage edge adjacent to and in-line with the area of the selvage edge to which the First Day of Issue cancellation seal is applied such that the terminal ends of the killer bar cancellation segments impinge upon and cancel the extra original stamp.

* * * * *